US007819501B2

(12) United States Patent
Hanchak et al.

(10) Patent No.: US 7,819,501 B2
(45) Date of Patent: Oct. 26, 2010

(54) JETTING MODULE INSTALLATION AND ALIGNMENT APPARATUS

(75) Inventors: Michael S. Hanchak, Dayton, OH (US); Mikhail Fishkin, Rochester, OH (US); Douglas E. Schultz, Dayton, OH (US); Charles D. Rike, Lebanon, OH (US); Robert J. Simon, Bellbrook, OH (US)

(73) Assignee: Eastman Kodak Company, Rochester, NY (US)

( * ) Notice: Subject to any disclaimer, the term of this patent is extended or adjusted under 35 U.S.C. 154(b) by 264 days.

(21) Appl. No.: 12/127,872

(22) Filed: May 28, 2008

(65) Prior Publication Data

US 2009/0295878 A1 Dec. 3, 2009

(51) Int. Cl.
*B41J 2/14* (2006.01)

(52) U.S. Cl. ..... 347/49; 347/50; 347/77

(58) Field of Classification Search ..... 347/50, 347/77, 82, 90, 108
See application file for complete search history.

(56) References Cited

U.S. PATENT DOCUMENTS

| | | | | |
|---|---|---|---|---|
| 4,080,607 | A | 3/1978 | Van Breemen et al. | |
| 5,257,043 | A | 10/1993 | Kneezel | |
| 6,068,367 | A * | 5/2000 | Fabbri | 347/49 |
| 6,250,738 | B1 * | 6/2001 | Waller et al. | 347/42 |
| 6,322,204 | B1 | 11/2001 | Blum et al. | |
| 6,471,335 | B1 | 10/2002 | Gelbart | |
| 2006/0268063 | A1 | 11/2006 | Inaoka et al. | |

FOREIGN PATENT DOCUMENTS

| | | |
|---|---|---|
| EP | 0 024 955 A1 | 3/1981 |
| EP | 0 668 167 A2 | 8/1995 |
| EP | 1 004 444 A2 | 5/2000 |

* cited by examiner

*Primary Examiner*—Lamson D Nguyen
(74) *Attorney, Agent, or Firm*—William R. Zimmerli

(57) ABSTRACT

A mechanism for aligning the jetting module in a continuous inkjet printhead and for making fluid and electrical connections to the jetting module without compromising the alignment is disclosed. A mechanism to aid in installing the jetting module is also disclosed.

20 Claims, 7 Drawing Sheets

JETTING MODULE INSTALLATION AND ALIGNMENT APPARATUS

FIELD OF THE INVENTION

The present invention relates generally to ink jet printing, and more specifically, to aligning and installing components of a continuous ink jet printhead.

BACKGROUND OF THE INVENTION

Ink jet printing systems are known in which a printhead includes a jetting module that defines one or more rows of nozzles in a nozzle plate which receive a recording fluid, such as a water-based ink, from a pressurized fluid supply manifold and eject the ink in rows of parallel streams. Such printing systems achieve image production by allowing drops which are to be printed to contact the recording medium and deflecting drops that are not to be printed to a drop catcher device.

Conventional methods for assembling the components of a printhead include locating the jetting module or drop generator with the aid of an assembly fixture, then using an adhesive such as epoxy to fasten it in place. A charge plate/catcher assembly is then aligned to the drop generator using external adjustment fixtures. Once a proper alignment is achieved, the charge plate/catcher assembly is fastened with screws or adhesive to the common frame holding the drop generator.

Traditional systems allow replacement of a printhead by creating field replaceable units which includes a jetting module, a charge plate, and a catcher. Some field replaceable units also include fluid system components such as valves and pressure and temperature sensors, and support electronics for the inkjet module. As the number of jets to be controlled increased, it became impractical to connect each charge electrode in the field replaceable printhead to the controlling charge driver electronics that were not part of the field replaceable printhead. In such printheads, it became preferable to include charge driver electronics in the field replaceable unit. As the charge plate was also subject to failure, such field replaceable units were preferable because, in addition to the jetting module, the charge plate was also field replaceable.

Unfortunately, existing assembly and alignment methods have several drawbacks. For example, using an adhesive increases assembly time because it takes several hours for the adhesive to cure and using epoxy is problematic because epoxy is sensitive to heat and humidity. Additionally, the final fastening of the charge plate/catcher assembly alters the alignment, usually requiring realignment.

High costs of shipping make it advantageous to replace only the jetting module rather then the entire printhead. Additionally, jetting modules providing higher resolution require high precision alignment. Accordingly, there is a need for a jetting module to be a field replaceable unit that an be properly aligned during installation.

SUMMARY OF THE INVENTION

According to a feature of the present invention, an apparatus for installing a jetting module in a printhead includes a drop deflection mechanism, a catcher, a printhead frame including a first set of mounting features, a jetting module including a second set of mounting features that correspond to the first set of mounting features of the printhead frame, and a coupling frame including a second set of fluid and electrical connections that correspond to a first set of fluid and electrical connections of the jetting module. The coupling frame provides a force to maintain contact between the first and second sets of mounting features after the first and second sets of mounting contact each other. The coupling frame also provides the force to maintain contact between the first and second sets of fluid and electrical connections after the first and second sets of fluid and electrical connections contact each other.

According to another feature of the present invention, a method for mounting a jetting module in a printhead including a drop deflection mechanism and a catcher includes providing a printhead frame including a first set of mounting features, providing a jetting module including a second set of mounting features that correspond to the first set of mounting features of the printhead frame, providing a coupling frame including a second set of fluid and electrical connections that correspond to a first set of fluid and electrical connections of the jetting module, causing the first and second sets of mounting features to contact each other, causing the first and second sets of fluid and electrical connections to contact each other, and providing a force to maintain contact between the first and second sets of mounting features, and between the first and second sets of fluid and electrical connections.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
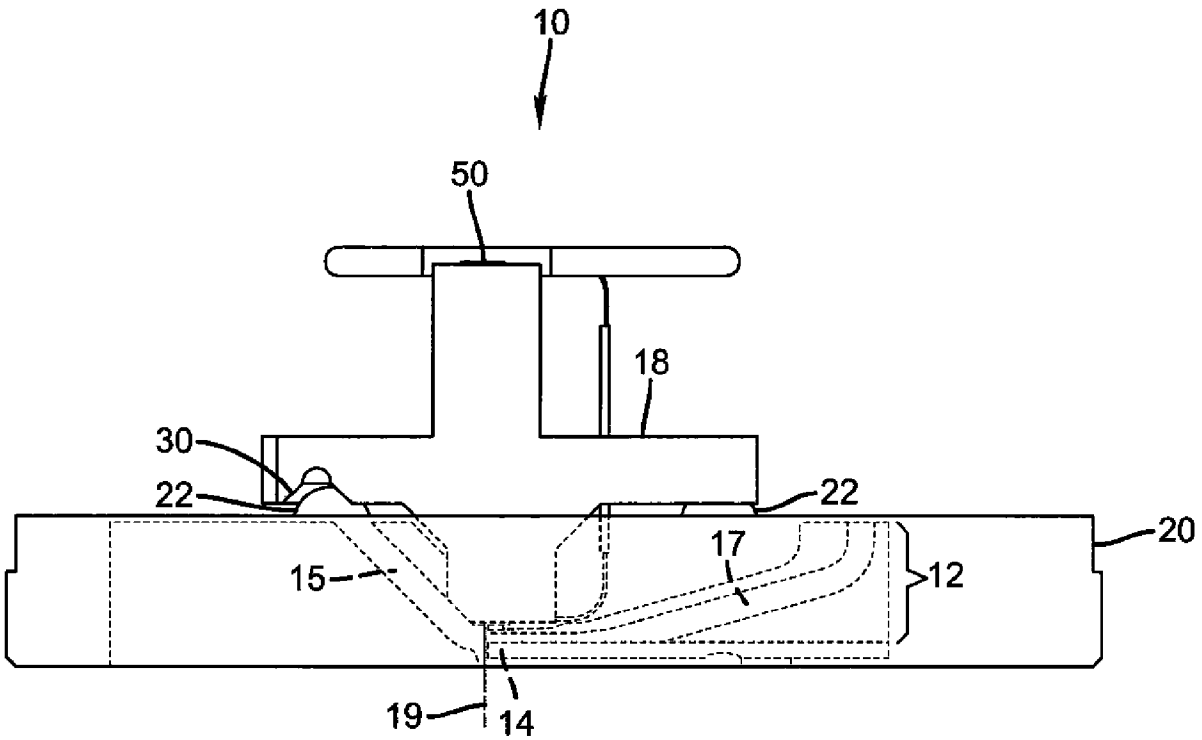
FIGS. 1A and 1B are schematic side views of a printhead including a jetting module, drop deflection mechanism and catcher in a printhead frame.

Referring to FIG. 1A, a printhead 10 according to the present invention includes a jetting module 18, a drop deflection mechanism 12, a catcher 14, and a frame 20. The drop deflection mechanism can be a gas flow deflection mechanism, such as is described in U.S. Pat. No. 6,588,888, an electrostatic deflection mechanism, such as is described in U.S. Pat. No. 4,636,808, or other drop deflection mechanisms known in the art. In FIG. 1, the invention the drop deflection mechanism is a gas flow deflection mechanism, including of a positive gas flow duct 15 and a negative gas flow duct 17. Positive gas flow duct 15 is connected to a fan or blower that produces a positive pressure in the gas flow duct from which a flow of gas is directed across the trajectories of drops 19 formed by the jetting module. Negative gas flow duct 17 is connected of a vacuum source, producing a vacuum or negative pressure in the gas flow duct. The suction of gas into duct 17 produces a flow of gas across the drop trajectories 19. Typically, the placement of the blower, vacuum source, and the gas flow duct extensions that connect the positive and negative gas flow ducts to the blower and vacuum source relative to the jetting module is controlled by the amount of available space around printhead 10. Catcher 14 is positioned under the negative gas flow duct 17, but can alternatively be located under the positive gas flow duct.

Operation of the printhead 10 depends critically on the alignment of catcher 14 and drop deflection mechanism 12 relative to jetting module 18. The printhead frame 20 includes a first set of mounting features 22, and at least one of the drop deflection mechanism 12 and the catcher 14 is affixed to the printhead frame 20. In a preferred embodiment, the catcher 14 and at least a portion of the drop deflection mechanism 12 are assembled together, and this catcher-drop deflector assembly is affixed to the printhead frame 20. The jetting module 18 includes a second set of mounting features 30 that correspond to the first set of mounting features 22 of the printhead frame 20. The second set of mounting features 30 can be integrally formed in the jetting module 18. The jetting module 18 also includes a first set of fluid and electrical connections 50.

Figure 1B:
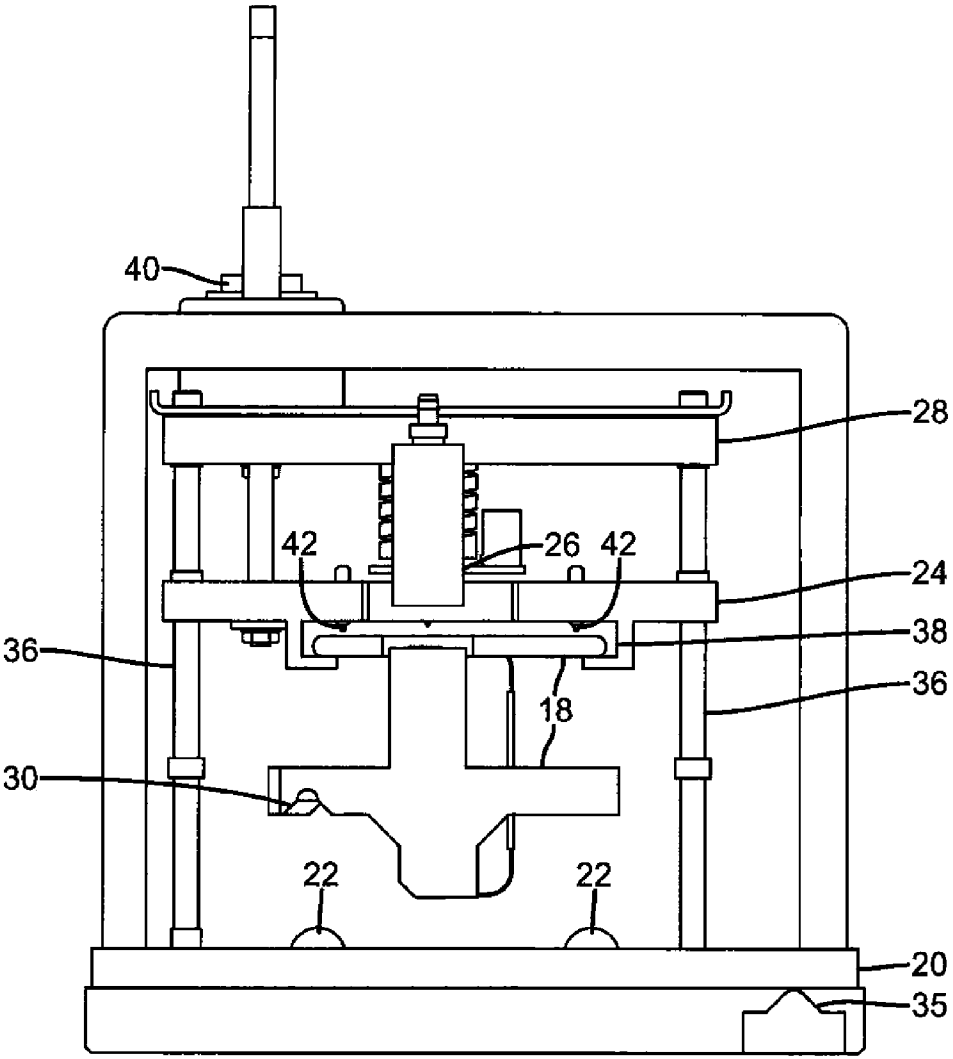

Referring to FIG. 1B, the printhead frame 20 includes a first set of mounting features 22, a carriage 24 for installing a jetting module 18, and a coupling frame 26 supported by a second carriage 28 to enable making fluid and electrical connections to the jetting module 18. The mounting features 22 are preferably kinematic alignment features. These kinematic alignment features allow the jetting module 18 to be precisely positioned in the printhead 10.

Figure 2:
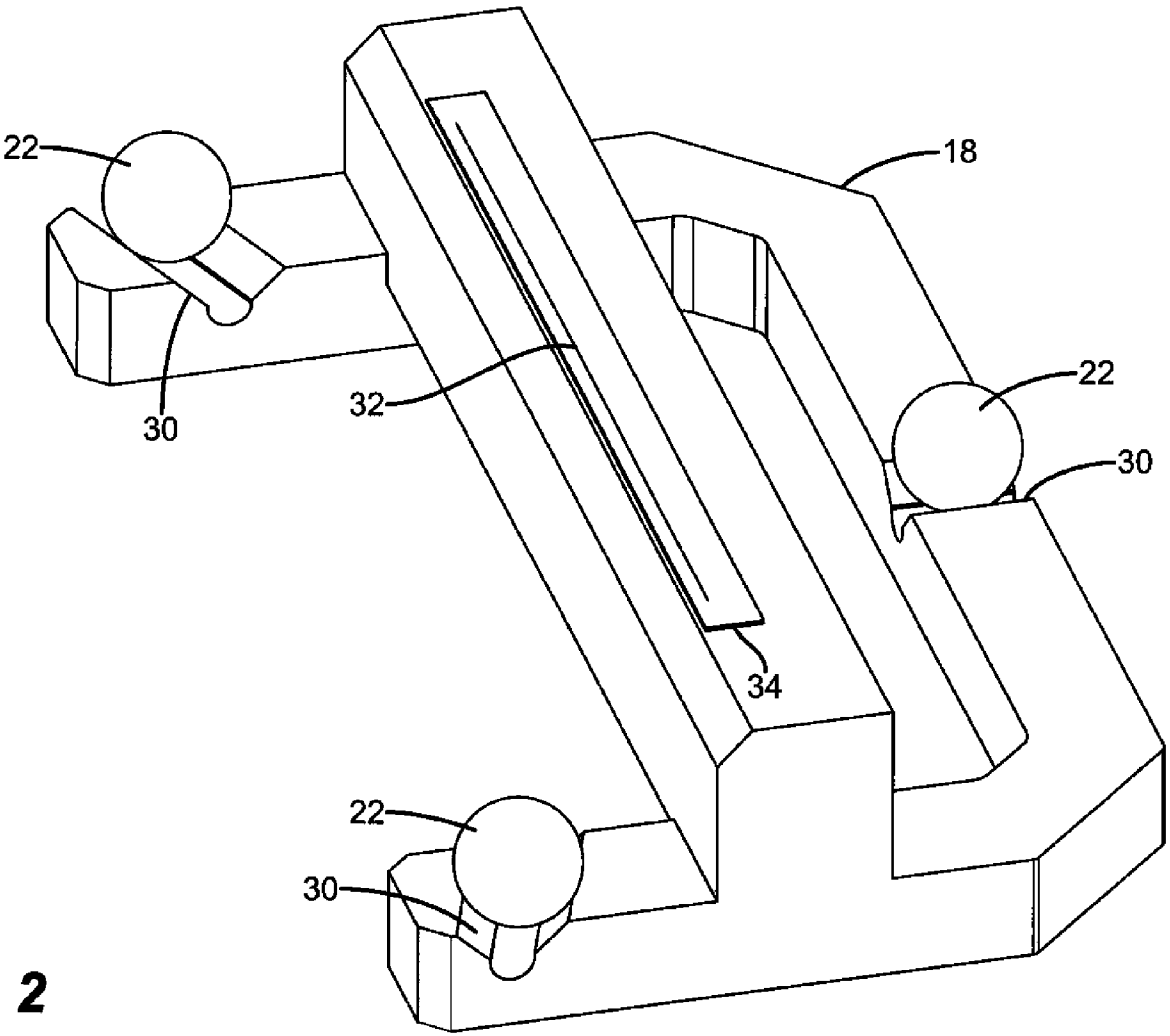
FIG. 2 is an inverted isometric view of a jetting module and first and second mounting features.

One type of kinematic alignment feature, known as a "2-2-2 mount" or a "three-groove mount" is shown in FIG. 2. FIG. 2 shows a jetting module, in an inverted position, to show the three V-groove alignment features 30. Spherical mounting features 22 are shown in each of the V-grooves. When the spacing of the three spherical mounting features 22 is fixed by some structure (which has been hidden in FIG. 2 to better show the engagement of the mounting features), the three V-groove mounting features 30 in the jetting module 18 can engage the three spherical mounting features (each groove contacting a sphere at two points) in only one position. When the jetting module 18 is separated from the spherical mounting features 22, the jetting module can be returned to the original position to high precision by again having the mounting features 30 engage the mounting features 22.

While the 2-2-2 mount is shown in the illustrated embodiments, other kinematic mount configurations, such as a "3-2-1 mount" can be employed. In a 3-2-1 mount, also known as a "cone, groove, and flat" mount, one set of alignment features is a system which includes three balls, and the second set of alignment features includes a cone shape, which constrains 3 degrees of freedom, a v-groove, which constrains 2 degrees of freedom, and a flat, which constrains one degree of freedom. In this way all six degrees of freedom can be defined.

The use of kinematic mount features can provide not only reproducible alignment of printhead components, such as the alignment of the jetting module 18 to the drop deflection mechanism 12, but they can be employed to enable interchangeability of parts. In the jetting module production process, fixtures that engage the mounting features 30 of the jetting module can be used to align the nozzle array 32 of nozzle plate 34 with high precision to the alignment features 30 of the jetting module 18. The nozzle plate 34 can then be secured in that aligned position using an epoxy or other adhesive bonding process. Similarly, fixtures that engage the mounting features 22 of the printhead frame 20 can be used to align the catcher-drop deflector assembly of the printhead 10 with high precision relative to the first set of mounting features 22. In this manner, the nozzle array 32 of the nozzle plate 34 attached to the jetting module 18 and the catcher-drop deflector assembly are each precisely aligned relative to the respective kinematic mounting features, so engagement of the kinematic features of the jetting modules 18 with the kinematic features of the printhead frame 20 produces consistent alignment of the nozzle array 32 to the gas flow ducts 15, 17 and the catcher 14.

The consistency of alignment of the critical printhead components, for example, nozzle array 32, drop deflection mechanism 12, and catcher 14, depend on the consistency of the mounting features 22, 30. The spherical mounting features 22 are therefore preferably fabricated from a material, for example, a ceramic or hardened metallic material, that won't be elastically deformed by the contact forces. It is also desirable to harden the contact surfaces of V-groove mounting features 30 that are machined into the jetting module. Alternatively, the contact surfaces of the grooves can comprise inserts of a material, such as a hardened metal or ceramic, that won't be elastically deformed by the contact forces.

In some embodiments, the mounting features 22 are located in three holes of printhead frame 20 that are machined precisely by jig grinding. Three spheres are then press fit into these holes. Alternatively, the mounting features 22 can be truncated spheres or hemispheres rather than complete spheres that are secured in the three holes of the printhead frame 20. As the mounting features 22 that are used to align the jetting module 18 are also used to align deflection mechanism 12 and catcher 14 to the printhead frame 22, small variations in the placement of the mounting features 22 from one printhead frame 20 to another don't produce alignment errors between the nozzle array 32 of the jetting module 18 and the deflection mechanism 12 and catcher 14 secured to the printhead frame 20. Similarly, small variations in the mounting features 30 of the jetting module 18 don't produce alignment errors of the between the nozzle array 32 of the jetting module 18 and the catcher-drop deflector assembly as the same mounting features 30 are used both for the locating the nozzle array 32 on the jetting module 18 and locating the jetting module 18 in the printhead frame 20.

Referring back to FIG. 1B, in some embodiments, the printhead frame 20 includes a third set of mounting features 35 that are precisely aligned to the mounting features 22. This third set of mounting features 35 enables the printhead 10, and more significantly the nozzle array 32, to be aligned with precision to other printer components, such as paper guides or other printheads.

While the mounting features 22, 30 of the jetting module 18 and the printhead frame 20 enable the jetting module 18 to be aligned with precision to the deflection mechanism 12 and catcher 14, alignment integrity can be compromised if the jetting module 18 isn't allowed to settle into proper engagement with the alignment features 22 of the printhead frame 20. The printhead 20 therefore includes an carriage 24 to enable the jetting module 18 to properly engage the alignment features 22 of the printhead frame 20.

Referring back to FIG. 1B, carriage 24 of the printhead frame 20 is located on guide posts 36 that allow the carriage 24 to move vertically, substantially perpendicular to the plane defined by the mounting features 22. The carriage includes a pocket 38 into which the jetting module 18 can be inserted when the carriage is in the up position as shown in FIG. 1B. The pocket 38 is shaped to receive the jetting module 18, and supports the jetting module 18 before lowering the jetting module 18 into position to engage the first set of mounting features 22 of the printhead frame 20. The pocket 38 serves to establish the location of the jetting module 18 sufficiently to enable the second set of mounting features 30 to contact the first set of mounting features 22, while providing sufficient clearance to allow the jetting module 18 to shift laterally as needed to properly engage the first set of mounting features 22 of printhead frame 20.

Figure 3:
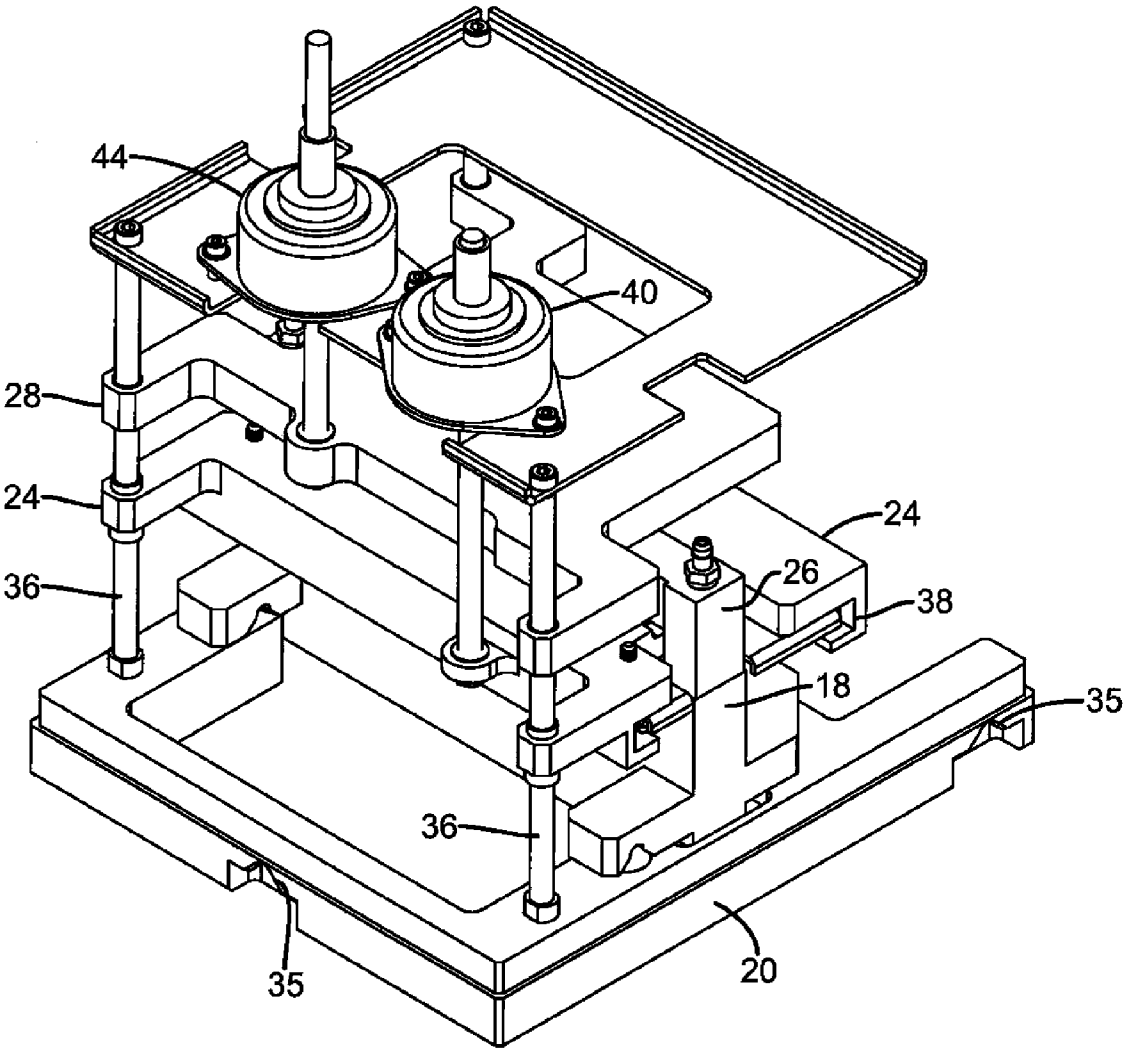
FIG. 3 is an isometric view of the printhead showing the carriages and actuators for installing the jetting module and making fluid and electrical connections to it.
Figure 4:
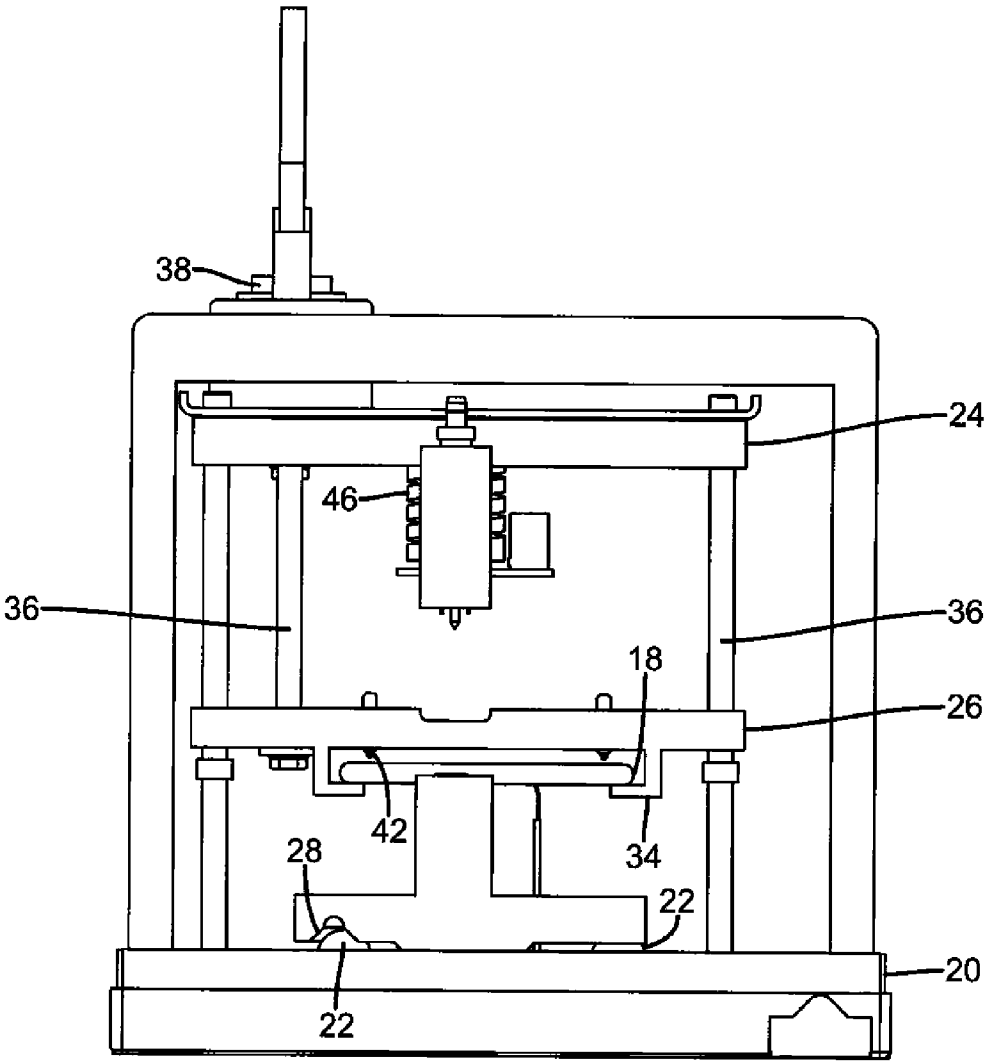
FIG. 4 is a side view of the printhead with the jetting module lowered into an aligned position without fluid and electrical connections having been made.

Referring to FIGS. 1B, 3 and 4, the carriage 24 is moved up and down on the guide posts 36 by an actuator 40. Actuator 40 may be a stepper motor, a solenoid, or any other actuator known to those in the art, so long as it operates to cause relative movement of the jetting module 18 to bring the first set of mounting features 22 of the printhead frame 20 and second set of mounting features 30 of the jetting module 18 into contact with each other. Actuator 40 causes the carriage 24 to be lowered and the second set of mounting features 30 of jetting module 18 are brought into contact the first set of mounting features 22 of the printhead frame 20 (shown in FIG. 4). The actuator 40 continues to lower the carriage 24, and the jetting module 18 lifts off from the pocket 38 allowing the jetting module 18 to shift laterally so that first set of mounting features 22 fully engages the second set of mounting features 30. As the carriage 24 continues to be lowered, load management features 42 begin to apply a load to the jetting module 18 to maintain secure alignment of the jetting module 18 with the printhead frame 20. In some embodiments, load management features 42 include spring plungers, though other load management features can be used, provided they do not produce an over-constraint to the system. The forces applied by each of the load management features 42 to the jetting module 18 are substantially perpendicular to the plane defined by the mounting features 22 to maintain the integrity of the alignment. The forces applied by the load management features 42 are applied at locations between the locations of the three mounting features 22 or 30 so as not to produce a torque on the jetting module 18 that could cause one of the three mounting features 22 or 30 to fail to fully engage the mating features 30 or 22 and thereby compromise the integrity of the alignment.

A second carriage 28 is also located on the guide posts 36. This second carriage 28 is moved up and down on the guide posts 36 by second actuator 44. A coupling frame 26 is attached to the second carriage 28 through a biasing mechanism 46.

Figure 5:
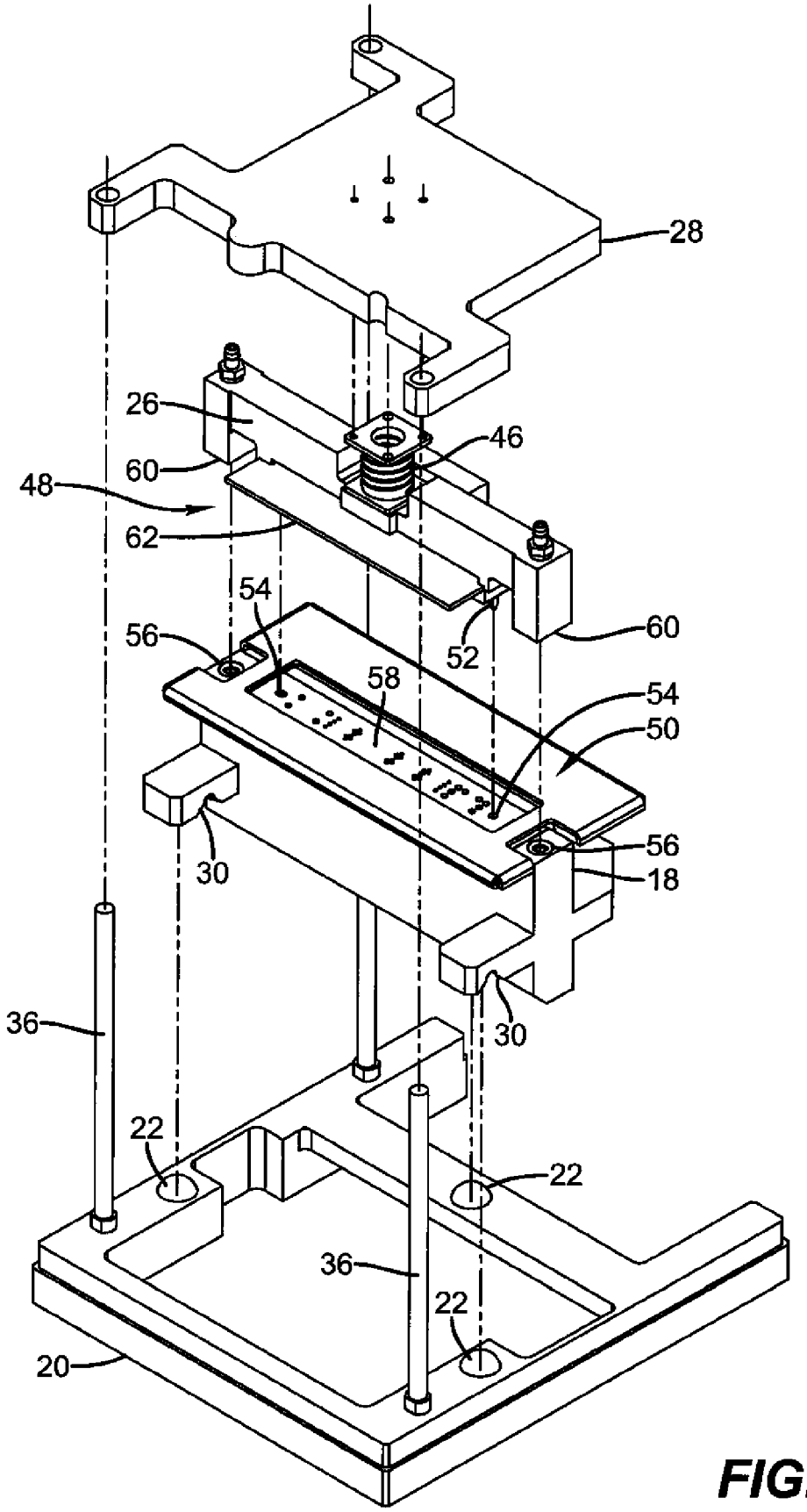
FIG. 5 is an exploded view of portions of the printhead showing fluid and electrical connections.

FIG. 5 provides an exploded view of portions of the printhead 10. The carriage 24 for locating the jetting module 18 has been omitted to enable the jetting module 18 and the fluid and electrical connects 50 to be seen more clearly. As shown in FIG. 5, the coupling frame 26 includes a second set of fluid and electrical connections 48 that are designed to mate with a first set of fluid and electrical connections 50 that are a part of the jetting module 18. After the carriage 24 has lowered the jetting module 18 into place so that the first and second set of mounting features 22, 30 are fully engaged, second actuator 44 is employed to lower the second carriage 28 and the attached coupling frame 26. Alignment pins 52 on the coupling frame 26 engage alignment holes 52 in the jetting module 18 to guide the coupling frame so that the appropriate fluid and electrical connections are made between the first and second sets of fluid and electrical connections 48 and 32.

As a result of the force on the coupling frame 26 provided by the biasing mechanism 46, the coupling frame 26 provides a force to maintain contact between the second set of mounting features 30 of the jetting module and the first set of mounting features 22 of the printhead frame after the second set of mounting features 30 of the jetting module 18 and the first set of mounting features 22 of the printhead frame 20 contact each other. The force provided by the coupling frame 26 also serves to maintain contact between the second set of fluid and electrical connections 48 of the coupling frame 26 and the first set of fluid and electrical connections 50 of the jetting module 18 after the second set of fluid and electrical connections 48 of the coupling frame 26 and the first set of fluid and electrical connections 50 of the jetting module 18 contact each other.

The first set of fluid and electrical connections 50 on the jetting module 18 can include one or more fluid ports 56 and an electrical contact board 58. The second set of fluid and electrical connectors 30 on the coupling frame 26 can include corresponding fluid ports 60 and an electrical contact board 62 having electrical contacts 64. Preferably, the fluid ports 55, 60 of the jetting module 18 and the coupling frame 26 are of a drip resistant type, preventing any fluid from dripping from the fluid ports 56, 60 while a jetting module 18 is being replaced. To prevent the fluid port connection from applying any lateral loads to the jetting module 18, o-ring face seals are used on at the fluid port 56 on the jetting module 18 as well as on the fluid port 56 mating port in the second set of fluid and electrical connections 48 on the coupling frame 26. Additionally, the mating fluid port in the second set of fluid and electrical connections 48 can be float mounted to the coupling frame 26 to ensure that proper sealing is achieved without providing any lateral forces. Likewise, the electrical contact board 58 in the first set of fluid and electrical connections 50 can be float mounted to the jetting module 18.

Figure 6:
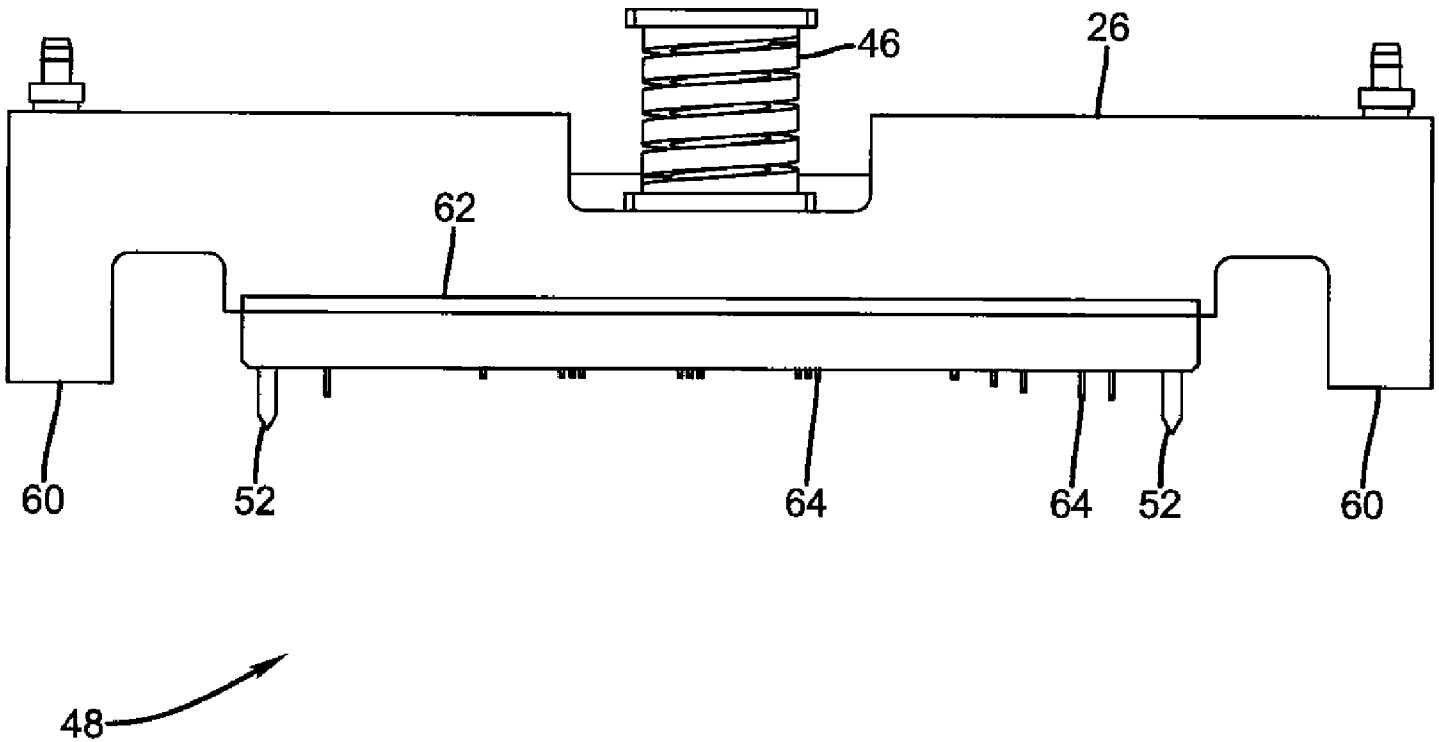
FIG. 6 is a front view of a coupling frame showing electrical connections.

Referring to FIG. 6 and back to FIG. 5, in some embodiments, electrical contacts 64 can be spring pin contacts that are attached to electrical contact board 62. This type of electrical contact 64 is commercially available from Interconnect Devices, Inc., Kansas City, Kans. Such electrical contacts 64 can vary in length as shown so electrical contacts 64 can make and break electrical contact with the corresponding contacts on the electrical contact board in a prescribed order so that the contacts to first make contact while establishing electrical connection are the last ones to break contact when such a connection is to be broken. Through the use of such first make-last break electrical connections, the printhead 10 can be made to safely replace a jetting module while electrical power is still supplied to the electrical contact board 62. Other types of first make-last break connections can be used, as can other types of electrical contacts in general, provided that they do not over constrain the system and therefore compromise the integrity of the jetting module alignment.

Coupling frame 26 is attached to the second carriage 44 by a biasing mechanism 46. Biasing mechanism 46 can be a spring, though other types of biasing mechanisms can be used, provided they are capable of providing a force to the jetting module 18 after the second set of mounting features 30 of the jetting module 18 and the first set of mounting features 22 of the printhead frame 20. The force provided by the biasing mechanism 46 through the coupling frame 26 is substantially perpendicular to the plane defined by the first set of mounting features 22. The biasing mechanism 46 provides sufficient compliance to the enable the coupling frame to rotate and shift laterally to enable all the fluid and electrical connections to be made without producing significant torques or lateral forces that would compromise the integrity of the alignment. To reduce the risk of the jetting module 18 shifting as the fluid and electrical connections are made it is preferable that load managing features 36 provide a force to the jetting module 18 before the coupling frame 26 begins to contact the jetting module 18. The second carriage 28 with the attached coupling frame 26 are lowered into position by an second actuator 44. This actuator can be a stepper motor, a solenoid, or any other actuator known to those in the art. Additionally, this actuator can be the same actuator as actuator 40, or it can be a second actuator as is shown in FIG. 3. Other embodiments can include limit switches and stall-sensing circuitry to enable the actuator to be stopped when the jetting module 18 is bearing the entire load, though other methods of controlling change in position can be used. The use of limit switches and stall-sensing circuitry allows the mechanism to recalibrate itself in the event of an unforeseen power failure during printhead installation.

The invention has been described in detail with particular reference to certain preferred embodiments thereof, but it will be understood that variations and modifications can be effected within the scope of the invention.

PARTS LIST

10 Printhead
12 Drop deflection mechanism
14 Catcher
15 Positive gas flow duct
17 Negative gas flow duct
19 Drop trajectories
18 Jetting module
20 Printhead frame
22 First set of mounting features
24 Carriage
26 Coupling frame
28 Second carriage
30 Second set of mounting features
32 Nozzle array
34 Nozzle plate
35 Third set of mounting features
36 Guide posts
38 Pocket
40 Actuator
42 Load management features
44 Second actuator
46 Biasing mechanism
48 Second set of fluid and electrical connections
50 First set of fluid and electrical connections
52 Alignment pin
54 Alignment hole
56 Fluid ports
58 Electrical contact board
60 Fluid ports
62 Electrical contact board
64 Electrical contacts

The invention claimed is:

1. An apparatus for installing a jetting module in a printhead including a drop deflection mechanism and a catcher, the apparatus comprising:

a printhead frame including a first set of mounting features, at least one of the drop deflection mechanism and the catcher being affixed to the printhead frame;

a jetting module including a second set of mounting features that correspond to the first set of mounting features of the printhead frame, the jetting module including a first set of fluid and electrical connections; and a coupling frame including a second set of fluid and electrical connections that correspond to the first set of fluid and electrical connections of the jetting module, the coupling frame providing a force to maintain contact between the second set of mounting features of the jetting module and the first set of mounting features of the printhead frame after the second set of mounting features of the jetting module and the first set of mounting features of the printhead frame contact each other, the coupling frame providing the force to maintain contact between the second set of fluid and electrical connections of the coupling frame and the first set of fluid and electrical connections of the jetting module after the second set of fluid and electrical connections of the coupling frame and the first set of fluid and electrical connections of the jetting module contact each other.

2. The apparatus of claim 1, further comprising:

a first actuator operable to cause relative movement of the jetting module and the printhead frame to bring the second set of mounting features of the jetting module and the first set of mounting features of the printhead assembly into contact with each other.

3. The apparatus of claim 2, the first set of mounting features defining a plane, wherein the relative movement of the jetting module and the printhead frame is perpendicular to the plane.

4. The apparatus of claim 2, further comprising:

a frame coupled to the first actuator, the frame including a pocket shaped to receive the jetting module.

5. The apparatus of claim 4, the force provided by the coupling frame being a first force, wherein the frame includes a biasing mechanism that to provides a second force to bias the jetting module toward the printhead frame after the second set of mounting features of the jetting module and the first set of mounting features of the printhead frame contact each other and at least prior to the force being provided by the coupling frame.

6. The apparatus of claim 5, wherein the biasing mechanism is a spring.

7. The apparatus of claim 6, wherein the first actuator and second actuator are the same actuator.

8. The apparatus of claim 2, further comprising:

a second actuator operable to cause relative movement of the jetting module and the coupling frame to bring the first set of fluid and electrical connections of the jetting module and the second set of fluid and electrical connections of the coupling frame into contact with each other.

9. The apparatus of claim 1, wherein the electrical connections are a first make-last break type connection.

10. The apparatus of claim 1, wherein the coupling frame includes a biasing mechanism that provides the force.

11. The apparatus of claim 1, wherein the coupling frame is compliantly mounted through a second carriage to the printhead frame so as not to provide lateral forces on the fluid and electrical connections.

12. The apparatus of claim 1, wherein the fluid connections are a drip resistant type connection.

13. The apparatus of claim 1, the first set of mounting features defining a plane, wherein the force provided by the coupling frame is perpendicular to the plane.

14. The apparatus of claim 1, wherein the printhead frame includes a third set of mounting features to align the printhead to another printer component.

15. The apparatus of claim 1, wherein the second set of mounting features of the jetting module are integrally formed in the jetting module.

16. The apparatus of claim 1, wherein the drop deflection mechanism is a gas flow deflection mechanism.

17. A method for mounting a jetting module in a printhead including a drop deflection mechanism and a catcher, the method comprising:

providing a printhead frame including a first set of mounting features, at least one of the drop deflection mechanism and the catcher being affixed to the printhead frame;

providing a jetting module including a second set of mounting features that correspond to the first set of mounting features of the printhead frame, the jetting module including a first set of fluid and electrical connections;

providing a coupling frame including a second set of fluid and electrical connections that correspond to the first set of fluid and electrical connections of the jetting module;

causing the second set of mounting features of the jetting module and the first set of mounting features of the printhead frame contact each other;

causing the second set of fluid and electrical connections of the coupling frame and the first set of fluid and electrical connections of the jetting module contact each other; and providing a force to maintain contact between the second set of mounting features of the jetting module and the first set of mounting features of the printhead frame, and to maintain contact between the second set of fluid and electrical connections of the coupling frame and the first set of fluid and electrical connections of the jetting module.

18. The method of claim 17, wherein causing the second set of fluid and electrical connections of the coupling frame and the first set of fluid and electrical connections of the jetting module contact each other occurs after causing the second set of mounting features of the jetting module and the first set of mounting features of the printhead frame contact each other.

19. The method of claim 17, the first set of mounting features defining a plane, wherein providing the force includes providing a force that is perpendicular to the plane.

20. The method of claim 17, wherein providing the coupling frame includes providing a coupling frame that is compliantly mounted through an second carriage to the printhead frame so as not to provide lateral forces on the fluid and electrical connections.

* * * * *